US006440267B1

(12) United States Patent
Rekoske et al.

(10) Patent No.: US 6,440,267 B1
(45) Date of Patent: Aug. 27, 2002

(54) SOFT CREPED TISSUE

(75) Inventors: Michael John Rekoske; Louise Cynthia Ellis Coe, both of Appleton; Frank Gerald Druecke, Oshkosh; James Martin Kaun, Neenah, all of WI (US); Sherri Lynn Laufenberg, Mukilteo, WA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/731,413

(22) Filed: Dec. 6, 2000

(51) Int. Cl.[7] ..... D21H 21/22

(52) U.S. Cl. ..... 162/111; 162/113; 162/112; 162/158

(58) Field of Search ..... 162/111, 112, 162/158, 109, 113

(56) References Cited

U.S. PATENT DOCUMENTS

| | | | | | |
|---|---|---|---|---|---|
| 5,494,554 | A | | 2/1996 | Edwards et al. | |
| 5,552,020 | A | * | 9/1996 | Smith et al. | 162/158 |
| 5,730,839 | A | | 3/1998 | Wendt et al. | |
| 5,904,810 | A | * | 5/1999 | Schroeder et al. | 162/158 |
| 5,993,602 | A | * | 11/1999 | Smith et al. | 162/158 |
| 6,033,761 | A | * | 3/2000 | Dwiggins et al. | 162/158 |
| 6,077,393 | A | * | 6/2000 | Shannon et al. | 162/158 |
| 6,120,644 | A | | 9/2000 | Schroeder et al. | |

* cited by examiner

*Primary Examiner*—Peter Chin
(74) *Attorney, Agent, or Firm*—Gregory E. Croft

(57) ABSTRACT

Soft tissues, such as facial tissues, having improved softness can be produced by incorporating two different softening compounds into the tissue, namely an imidazolinium quaternary compound and a cationic amidoamine compound.

10 Claims, 3 Drawing Sheets

SOFT CREPED TISSUE

BACKGROUND OF THE INVENTION

The use of debonders and softening agents in facial and bath tissue is a common practice in the tissue industry because of consumer demand for soft products. However, even though the level of softness has increased generally over the years, industry efforts continue in order to provide further improvements in softness for facial and bath tissues.

SUMMARY OF THE INVENTION

It has been discovered that the perceived softness of tissue products can be improved by producing a tissue structure containing two different chemical softening additives, namely an imidazolinium quaternary compound and a cationic amidoamine compound. With proper formation and creping, the synergistic combination of these two different softening additives results in a unique tissue structure that is surprisingly soft. More specifically, the tissues of this invention have a combination of low internal density, a high formation index and a high surface smoothness.

Hence in one aspect, the invention resides in a soft tissue comprising from about 0.01 to about 1 dry weight percent of a imidazolinium quaternary compound and from about 0.01 to about 1 dry weight percent of a cationic amidoamine compound, said tissue having a Formation Index of 160 or greater, a Void Volume of 9.0 grams per gram or greater and a crepe structure, as measured by the Optical Surface Crepe method, having 60 or fewer crepe peaks having a peak height of 93 microns or greater.

In another aspect, the invention resides in a method of making a soft tissue comprising the steps of: (a) adding an imidazolinium quaternary compound to an aqueous suspension of papermaking fibers; (b) depositing the papermaking fibers onto a papermaking fabric to form a wet web; (c) partially dewatering the wet web; (d) pressing the dewatered web against the surface of a Yankee dryer, wherein the surface of the Yankee dryer contains a creping adhesive and a cationic amidoamine; and (e) drying the web and creping the dried web from the surface of the Yankee dryer such that the resulting tissue has a Formation Index of 160 or greater, a Void Volume of 9.0 grams per gram or greater and a crepe structure, as measured by the Optical Surface Crepe method, having 60 or fewer crepe peaks having a peak height of 93 microns or greater.

As used herein, imidazolinium quaternary compounds useful for purposes of this invention have the following structure:

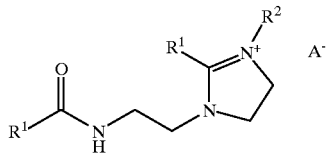

where:

$R^1$=saturated or unsaturated, substituted or unsubstituted, aliphatic hydrocarbon having a carbon chain length of 8 or greater;

$R^2$=$C_{1-4}$ alkyl; and $A^-$ any suitable anion including, but not limited to, $Cl^-$, $Br^-$, $F^-$, or $R_2SO_4^-$.

The imidazolinium quaternary compound is suitably added at the wet end of the tissue making process, such as adding it to the thick stock prior to web formation, where the consistency of the aqueous papermaking fiber suspension is about 2 percent or greater. The imidazolinium quaternary compound can be added to the papermaking fiber suspension of a blended (non-layered) tissue or a layered tissue. If the tissue is to be layered, the imidazolinium quaternary compound can be added to the furnish of the layer that ultimately contacts the creping cylinder surface. In most cases, this will also be the layer that is the outwardly facing layer of the final tissue product, which the consumer contacts.

The amount of the imidazolinium quaternary compound in the finished tissue product can be any amount, more specifically from about 0.01 to about 1 dry weight percent, more specifically from about 0.05 to about 0.5 dry weight percent, based on the dry weight of the fiber in the finished product. Lesser amounts are less effective in providing adequate softness. Greater amounts are effective and can be used, but are less attractive economically.

Suitable imidazolinium quaternary compounds are well known in the art. Suitable commercially available imidazolinium quaternary compounds include: Varisoft 3590 (Witco Corporation); DPSC 5299-8, which is a quaternary imidazolinium blended with a fatty acid alkoxylate and a polyether with a 200–300 molecular weight (Witco Corporation); ProSoft TQ-1003 (Hercules Incorporated); and Mackernium DC-183 (McIntyre Corporation).

In addition to the imidazolinium quaternary compound, nonionic surfactants and/or polyhydroxy compounds can also be added to the tissue at the wet end of the tissue making process to further enhance the softness of the final product. Examples of useful nonionic surfactants and polyhydroxy compounds are disclosed in U.S. Pat. No. 5,730,839 issued Mar. 24, 1998 to Wendt et al., which is hereby incorporated by reference.

The cationic amidoamine compound is suitably added after the tissue has been formed and at least partially dewatered. This can be accomplished by spray application onto the tissue web while supported by a fabric or felt or by application directly to the Yankee dryer by any suitable means such that it is subsequently transferred to the tissue. Suitable commercial cationic amidoamine compounds include Quaker 2008 (Hercules, Incorporated). Other suitable cationic amidoamine compounds include those disclosed by U.S. Pat. No. 6,120,644 to Schroeder et al., which is hereby incorporated by reference.

The amount of the cationic amidoamine compound in the finished product can be from about 0.01 to about 1 dry weight percent, more specifically from about 0.05 to about 0.5 dry weight percent, based on the dry weight of the fiber in the finished product.

DESCRIPTION OF TEST METHODS

Optical Surface Crepe

Figure 1:
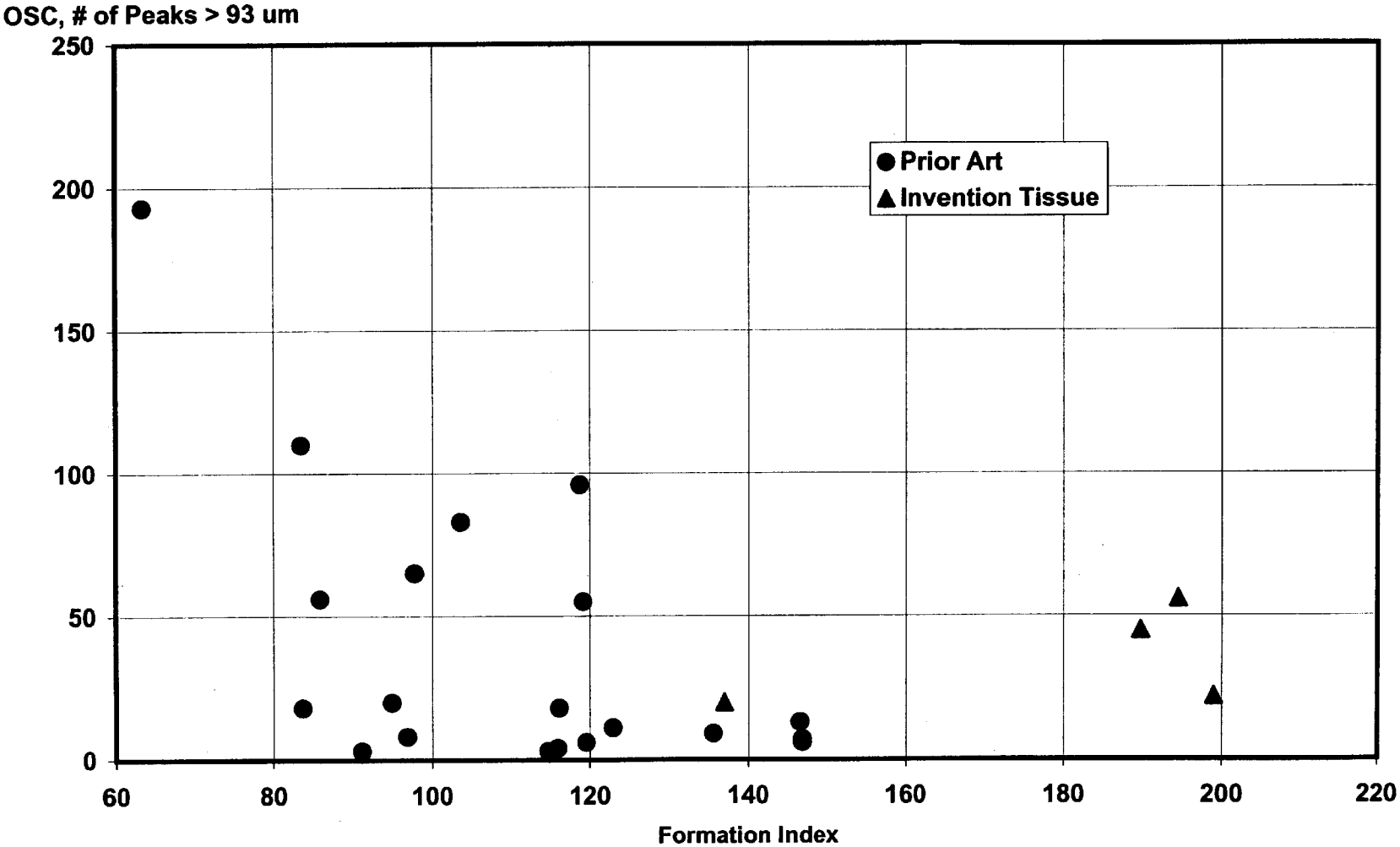
FIG. 1 is a plot of the number of crepe folds having a height of less than 93 microns (Optical Surface Crepe) versus the Formation Index for a number of prior art tissues and for several tissues of this invention.

The Optical Surface Crepe test is carried out according to the procedure disclosed in the Wendt, et al. patent (U.S. Pat.

No. 5,730,839), previously incorporated by reference. The test method provides a count of the height of crepe folds as well as the distance between crepe valleys. The output of the test is average crepe height and average distance between crepe valleys. The output also shows the distribution of the count in various size ranges. FIG. 5 of Wendt et al. provides a schematic representation of the apparatus used to measure the crepe structure as will be described below.

As described in Wendt et al., a collimated light source (a slide projector) projects the light at a 30-degree angle off the object plane. The prepared tissue sample is positioned flat on the table top with the crepe pattern aligned at a 90 degree angle with respect to the light source, resulting in shadows cast by the crepe folds as illustrated by the dotted lines. The reflected light is viewed and analyzed by the Quantimet camera having a 50-millimeter lens. To measure optical surface crepe using the set up described in FIG. 5 of Wendt et al., wrinkle free tissue samples are mounted on 10 by 12-inch glass plates by adhering with SCOTCH® tape in corners, and drawing tissue snug under mild tension. One layer is used for bath; two layers (plies) are used for facial. A 5 by 5-inch patch of tissue is "painted" with a ⅔: ⅓ mixture of PENTELS correction fluid and isopropyl alcohol, using a top quality camel's hair brush and applying in one direction only. A 20-minute drying time is sufficient. The glass plates with painted tissue are placed on the automacrostage (DCI 12 by 12 inch) of a Cambridge Quantimet 900 Image Analysis System, under the optical axis of a 50-mm EI Nikkor lens. The sample is illuminated at 30 degrees with a slide projector to form shadows. The software routine "OCREP5" (which is set forth in columns 7 and 8 of Wendt et al.) is run to perform the analysis. Accurate shading correction and system calibration are performed first. A two histogram print out is obtained typically after 15 one-centimeter fields of view are analyzed. The first histogram measures peak heights. The second histogram measures valley distances.

For purposes herein, the following minor adjustments to the optical surface crepe procedure disclosed in Wendt, et al. were used. First, a Chalnicon scanner was used in place of the Newvicon LV scanner listed in the Wendt method. Second, with this new scanner it was necessary to adjust the detection statement in the "OCREP5" method of Wendt et al. from "darker than 24" to "darker than 36".

Formation Index

The "Formation Index" is described by U.S. Pat. No. 5,494,554 issued Feb. 27, 1996 to Edwards et al., which is hereby incorporated by reference. As described therein, the Formation Index is measured using a digital image analysis system with a minimum pixel density of 512 (horizontal) by 480 (vertical) and 8 bit resolution (giving 256 gray levels). Several commercial systems are available with these specifications including the Zeiss IBAS image analysis system (available from Carl Zeiss, Inc. in Thornwood, N.Y.) and the Leica/Cambridge 900 Series image analysis system (available from Leica, Inc. in Deerfield, Ill.). Alternatively, an image analyzer suitable for the measurement of the Formation Index can be constructed from a "386 Class" personal computer containing a video frame grabber card such as the Imaging Technology VP1400-KIT-640-U-AT (manufactured by Imaging Technology Inc. of Bedford, Mass.) or equivalent frame grabbers from Data Translation (of Boston, Mass.) or other vendors. Such personal computer-based systems are most effectively operated using specialized image analysis software such as Optimas (available from Optimas Inc., Edmonds, Wash.). Many other such software packages are available for the different frame grabber cards.

Whatever image analysis system is used, a video camera system is used for image input. Either image tube cameras or solid state cameras such as those utilizing Charge Coupled Devices may be used. The chosen camera must have a gamma value of between 0.9 and 1.0. One such camera is a Dage Model 68 camera containing a Newvicon sensing tube (available from Dage MTI, Michigan City, Ind.).

A 35 mm. focal length lens is used with the camera. Any high quality lens may be used, such as the Nikon Nikkor 35 mm., f/2 autofocus lens (manufactured by Nikon, Inc., Japan). The lens is attached to the camera through suitable adapters. Typically, the lens is operated with its aperture set to f/5.6.

The camera system views a tissue sample sandwiched between a plate of diffuser plastic and window glass. This sandwich is placed on the center of a light box having dimensions of greater than 8 inches in each direction. Whatever light box is used, it must have a uniform field of Lambertian (diffuse) illumination of adjustable intensity. The method of intensity adjustment must not change the color temperature of the illumination. One appropriate light box is the ChromoPro Model 65 illuminator with optional diffuser table (available from Byers Photo Equipment Co. of Portland, Oreg.).

Specifically, samples for the Formation Index are single-ply tissue sheets cut to 4-inch by 4-inch squares, with one side aligned with the machine direction of the test material. Each specimen is placed on a square 4-inch by 4-inch piece of nominally ⅛-inch thick Plexiglas MC acrylic sheet (available from Rohm and Haas, Philadelphia, Pa.) such that the side of the tissue sheet that contacted the Yankee dryer during manufacture is facing up, away from the acrylic sheet. The tissue sheet is then covered with a 4-inch by 4-inch by nominally ⅛-inch thick piece of window glass containing no visible scratches or optical imperfections.

The specimen "sandwich" is set, glass side up, on the light box so that the center of the sandwich is aligned with the center of the illumination field. All other natural or artificial room light is extinguished. The camera is adjusted so that its optical axis is perpendicular to the plane of the tissue sheet and so that its video field is centered on the center of the specimen sandwich. The machine direction of the specimen is aligned with the vertical direction of the camera field. The camera is then positioned along its optical axis until its entire field of view contains exactly two inches of the specimen in the horizontal direction. The camera is focused so that the resulting picture contrast, measured as the standard deviation of the pixel array formed by digitization of the image, is maximized.

Next, the sample sandwich is replaced with a 4-inch by 4-inch piece of the acrylic sheet that does not have a specimen mounted. This acrylic sheet also is placed in the center of the light box, but it is not covered with a piece of window glass. The light box intensity is adjusted so that the mean value of the pixel array formed by digitization of this image averages 160 gray levels, plus or minus 0.4 gray levels. 32 frames of this image are then averaged into the frame grabber memory as a shading correction image.

The specimen sandwich is again placed on the light box, in the same position and alignment as it was previously. The light box illumination is adjusted so that the mean value of the resulting pixel array representing the tissue picture is again 160 gray levels plus or minus 0.4 gray levels. 32 frames of the tissue image are averaged into another part of the frame grabber memory.

The Formation Index is calculated by correcting the tissue image for light box shading, preferably by using an additive shading correction procedure. A precursor of the Formation Index is then calculated from the variance of the shading corrected pixel array as:

$$\text{Precursor}=(16/(\text{pixel array variance}))$$

Image analyzer systems have intrinsic response differences due to design differences between various manufacturers and also due to normal component variation. Therefore, an image analysis system must be calibrated against a set of fourteen known tissue standards before the final Formation Index can be calculated. These tissue standards (available from Kimberly-Clark Corporation, Neenah, Wis.) are tested on a "standard" image analysis system and are individually rated as to the expected value of the Formation Index along with its standard deviation when tested on appropriate equipment. The standards used for calibration are listed in Edwards et al. at columns 7 and 8.

The image analysis system is calibrated against these tissue standards by measuring each standard on the system and obtaining a Precursor value. Each standard is individually measured at least three times and the average Precursor value for each standard is used as the independent variable in a least squares linear regression utilizing the specified standard's Formation Index as the dependent variable. If the equipment is properly set up, the coefficient of determination for this regression should be greater than 0.95.

The linear regression procedure gives a slope value, which is herein referred to as the "m" value, and an intercept value, which is herein referred to as the "b" value. The Formation Index can be calculated for any specimen by measuring its Precursor value and using the following equation.

The image analysis system must have new values of the calibration coefficients, m and b, calculated occasionally. While the frequency of this calibration depends, in general, on the stability of the image analysis system, best measurement of the Formation Index is made when calibration is carried out at each power-up of the formation analyzer system, or on a daily basis, if the image analyzer is left powered-up.

Void Volume

As used herein, "Void Volume" is determined by saturating a sheet with a nonpolar liquid and measuring the volume of liquid absorbed. The volume of liquid absorbed is equivalent to the void volume within the sheet structure. The Void Volume is expressed as grams of liquid absorbed per gram of fiber in the sheet. The test is described in Edwards et al., previously incorporated by reference.

More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiply samples should be separated into individual single plies and 8 sheets from each ply position used for testing. Weigh and record the dry weight of each test specimen to the nearest 0.001 gram. Place the specimen in a dish containing POROFIL™ pore wetting liquid of sufficient depth and quantity to allow the specimen to float freely following absorption of the liquid. (POROFIL™ liquid, having a specific gravity of 1.875 grams per cubic centimeter, available from Coulter Electronics Ltd., Northwell Drive, Luton, Beds., England; Part No. 9902458.) After 10 seconds, grasp the specimen at the very edge (1–2 millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Ltd., Maidstone, England) in order to remove any excess of the last partial drop. Immediately weigh the specimen, within 10 seconds, recording the weight to the nearest 0.001 gram. The Void Volume for each specimen, expressed as grams of POROFIL™ per gram of fiber, is calculated as follows:

$$\text{Void Volume}=[(W_2-W_1)/W_1]$$

wherein "$W_1$" is the dry weight of the specimen, in grams; and "$W_2$" is the wet weight of the specimen, in grams. The Void Volume for all eight individual specimens is determined as described above and the average of the eight specimens is the Void Volume for the sample.

EXAMPLES

Example 1

Invention

A soft creped facial tissue was produced in accordance with this invention using a layered headbox and a conventional wet press process. More specifically, the first stock layer contained 100 percent eucalyptus hardwood fiber, which made up 65 percent of the sheet by weight. This layer is the first layer to contact the forming fabric. Because it is transferred to a carrier felt, it is also the layer that contacts the drying surface. The second stock layer contained 100 percent northern softwood kraft. It made up 35 percent of the sheet by weight. An imidazolinium quaternary compound (methyl-1-oleylamidoethyl-2-oleyl imidazolinium methylsulfate, identified as Witco C-6001, commercially available from Witco Corporation) was added as a mixture with water at 2 percent solids. The addition rate was 0.18 percent of the fiber in the entire sheet. The addition was made to the eucalyptus thick stock, which was at 2.3 percent solids. The dryer basis weight of the sheet was 7.0 pounds per 2880 square feet of air dried tissue. A wet/dry strength agent, Parez 631NC commercially available from Cytec Industries, Inc., was added to the softwood layer as a 0.9 percent mixture with water. The addition rate was 0.05 percent of the fiber in the entire sheet. It was added to the thick stock which was at 1.8 percent solids. To provide permanent wet strength to the tissue, Kymene 6500, available from Hercules, Inc. was also added to both the softwood and eucalyptus layers as a mixture with water at 1.8% solids. The addition rate was 0.1 percent of the fiber in the entire sheet. The softwood thick stock was also passed through a standard double-disk refiner to generate tissue strength. The two plates of the double-disk refiner were not closed, which is called no-load refining. The sheet was formed on an Albany MicroTex P-621 multi-layer polyester forming fabric, available from Albany International. It was transferred to a conventional wet press carrier felt. The water content of the sheet on the felt just prior to transfer to the Yankee dryer was about 88 percent. The sheet was transferred to the Yankee dryer with a vacuum pressure roll. Nip pressure was about 230 pounds per square inch and vacuum equaled about 10 inches of Mercury. Sheet moisture after the pressure roll was about 50 percent. The adhesive mixture sprayed onto the Yankee surface just before the pressure roll consisted of equal parts of polyvinyl alcohol and polyamide resin. The spray application rate was about 5.5 pounds of dry adhesive per tonne of dry fiber. A cationic amidoamine, Quaker 2008 available from Hercules, Inc, was applied to the tissue by spraying onto the Yankee dryer along with the adhesive mixture. The addition rate of the cationic amidoamine was about 0.06 percent of the fiber in the entire sheet. The creping pocket angle was 83 degrees. A natural gas heated hood partially around the Yankee had a supply air temperature of about 650° F. to assist in drying. Sheet moisture after the creping blade was about 1 percent. Machine speed of the 24 inch wide sheet was 3000 feet per minute. The crepe ratio was 1.30 or 30 percent crepe. This tissue was plied together and calendered with two steel rolls at 60 pounds per lineal inch. The 2-ply product had the dryer/softener layer plied to the outside. The finished basis weight of the 2-ply tissue at TAPPI standard temperature and humidity was 17.1 pounds per 2880 square feet. The MD tensile was 752 grams per 3 inches and the CD tensile was 354 grams per 3 inches. The thickness of one 2-ply tissue was 0.0087 inches. MD stretch in the finished tissue was 16 percent. All tensile tests were at TAPPI conditions. The crepe structure of the resulting finished tissue had only 45 crepe peaks having a height of 93 microns or great as measured by the Optical Surface Crepe method. The Void Volume was 10.1 grams per gram. The Formation Index was 190.

Example 2

Invention

A soft tissue was made as described in Example 1, except the double-disk refiner on the softwood thick stock layer was loaded at a level of 2 Horsepower*Day per tonne of dry fiber through the refiner. This finished tissue had an MD tensile of 1198 grams per 3 inches and a CD tensile of 638 grams per 3 inches. The thickness of one 2-ply tissue was 0.0088 inches. MD stretch in the finished tissue was 18.3 percent. All tensile tests were at TAPPI conditions. The crepe structure of the resulting finished tissue had only 22 crepe peaks having a height of 93 microns or great as measured by the Optical Surface Crepe method. The Void Volume was 9.7 grams per gram. The Formation Index was 199.

Example 3

Invention

A soft tissue was made as described in Example 2, except a different imidazolinium quaternary compound was used. Witco C-6027, commercially available from Witco Corporation) was added as a mixture with water at 2 percent solids, with the same addition rate of 0.18 percent of the fiber in the entire sheet. This imidazolinium quaternary compound contains the same active imidazoline chemical (methyl-1-oleylamidoethyl-2-oleyl imidazolinium methylsulfate), with small changes in the other components in the formulation used to make the composition liquid at room temperature. This finished tissue had an MD tensile of 926 grams per 3 inches and a CD tensile of 433 grams per 3 inches. The thickness of one 2-ply tissue was 0.0087 inches. MD stretch in the finished tissue was 19.4 percent. All tensile tests were at TAPPI conditions. The crepe structure of the resulting finished tissue had only 56 crepe peaks having a height of 93 microns or great as measured by the Optical Surface Crepe method. The Void Volume was 9.9 grams per gram. The Formation Index was 195.

Example 4

Invention

A soft tissue was made as described in Example 1, except it was produced on a full-scale tissue machine using a layered headbox and a conventional wet press process. More specifically, the first stock layer contained 100 percent eucalyptus hardwood fiber, which made up 52 percent of the sheet by weight. This layer is the first layer to contact the forming fabric. Because it is transferred to a carrier felt, it is also the layer that contacts the drying surface. The second stock layer contained 73 percent northern softwood kraft fiber and 23 percent eucalyptus hardwood fiber. This layer made up 48 percent of the sheet by weight. An imidazolinium quaternary compound (methyl-1-oleylamidoethyl-2-oleyl imidazolinium methylsulfate, identified as McIntyre DC-183, commercially available from McIntyre Corporation) was added as a mixture with water at 2 percent solids. The addition rate was 0.07 percent of the fiber in the entire sheet. The addition was made to the eucalyptus thick stock in the pulper, which was at 6 percent solids. The dryer basis weight of the sheet was 6.8 pounds per 2880 square feet of air dried tissue. A wet/dry strength agent, Hercobond 1336 commercially available from Hercules, Inc., was added to the softwood layer as a 7.9 percent mixture with water. The addition rate was 0.09 percent of the fiber in the entire sheet. It was added to the softwood thick stock that was at 3 percent solids. To provide permanent wet strength to the tissue, Kymene 557K, available from Hercules, Inc. was also added to the softwood layer as a mixture with water at less than 1 percent solids. The addition rate was 0.014 percent of the fiber in the entire sheet. The softwood thick stock was also passed through a standard double-disk refiner to generate tissue strength. The two plates of the double-disk refiner were loaded at a level of 2.5 Horsepower*Day per tonne of dry fiber through the refiner. The sheet was formed on an Albany MicroTex P-621 multi-layer polyester forming fabric, available from Albany International. It was transferred to a conventional wet press carrier felt. The water content of the sheet on the felt just prior to transfer to the Yankee dryer was about 88 percent. The sheet was transferred to the Yankee dryer with a vacuum pressure roll. Nip pressure was about 230 pounds per square inch and vacuum equaled about 12.6 inches of Mercury. Sheet moisture after the pressure roll was about 42 percent. The adhesive mixture sprayed onto the Yankee surface just before the pressure roll consisted of about one part of polyvinyl alcohol and four parts of polyamide resin. The spray application rate was about 5.4 pounds of dry adhesive per tonne of dry fiber. A cationic amidoamine, Quaker 2008 available from Hercules, Inc. was applied to the tissue by spraying onto the Yankee dryer along with the adhesive mixture. The addition rate of the cationic amidoamine was about 0.06 percent of the fiber in the entire sheet. The creping pocket angle was 83 degrees. A natural gas heated hood partially around the Yankee had a supply air temperature of about 722° F. to assist in drying. Sheet moisture after the creping blade was about 1 percent. Machine speed was 4700 FPM on the Yankee dryer. The crepe ratio was 1.26 or 26 percent crepe. This tissue was plied together and calendered with two steel rolls at 80 pounds per lineal inch. The 2-ply product had the dryer/softener layer plied to the outside. The finished basis weight of the 2-ply tissue at TAPPI standard temperature and humidity was 16.9 pounds per 2880 square feet. The MD tensile was 897 grams per 3 inches and the CD tensile was 480 grams per 3 inches. The thickness of one 2-ply tissue was 0.0075 inches. MD stretch in the finished tissue was 16 percent. All tensile tests were at TAPPI conditions. The crepe structure of the resulting finished tissue had only 20 crepe peaks having a height of 93 microns or great as measured by the Optical Surface Crepe method. The Void Volume was 9.1 grams per gram. The Formation Index was 137. The amount of McIntyre DC-183 imidazolinium quaternary compound in this tissue was quantified at 0.05 percent and the amount of Quaker 2008 cationic amidoamine in this tissue was quantified at 0.016 percent, based on the fiber weight in the entire sheet. Two hundred twenty-six consumers evaluated this softness of this tissue, utilizing a paired comparison with PUFFS® facial tissue from 1st Quarter 2000. The results from this study showed that 68% of consumers found that the tissue of this invention was softer than PUFFS.

Example 5

Comparative

A soft tissue was made as described in Example 4, except the imidazolinium quaternary compound was not added. This finished tissue had an MD tensile of 911 grams per 3 inches and a CD tensile of 487 grams per 3 inches. The thickness of one 2-ply tissue was 0.0077 inches. MD stretch in the finished tissue was 16 percent. All tensile tests were at TAPPI conditions. The crepe structure of the resulting finished tissue had 11 crepe peaks having a height of 93 microns or great as measured by the Optical Surface Crepe method. The Void Volume was 8.2 grams per gram. The Formation Index was 132. Over two hundred consumers evaluated the softness of this tissue, utilizing a paired comparison with PUFFS facial tissue. The results from this study showed that 54% of consumers found that PUFFS was softer than this tissue. Clearly, the tissue of this example did not have the desirable softness of the tissue of this invention.

Figure 2:
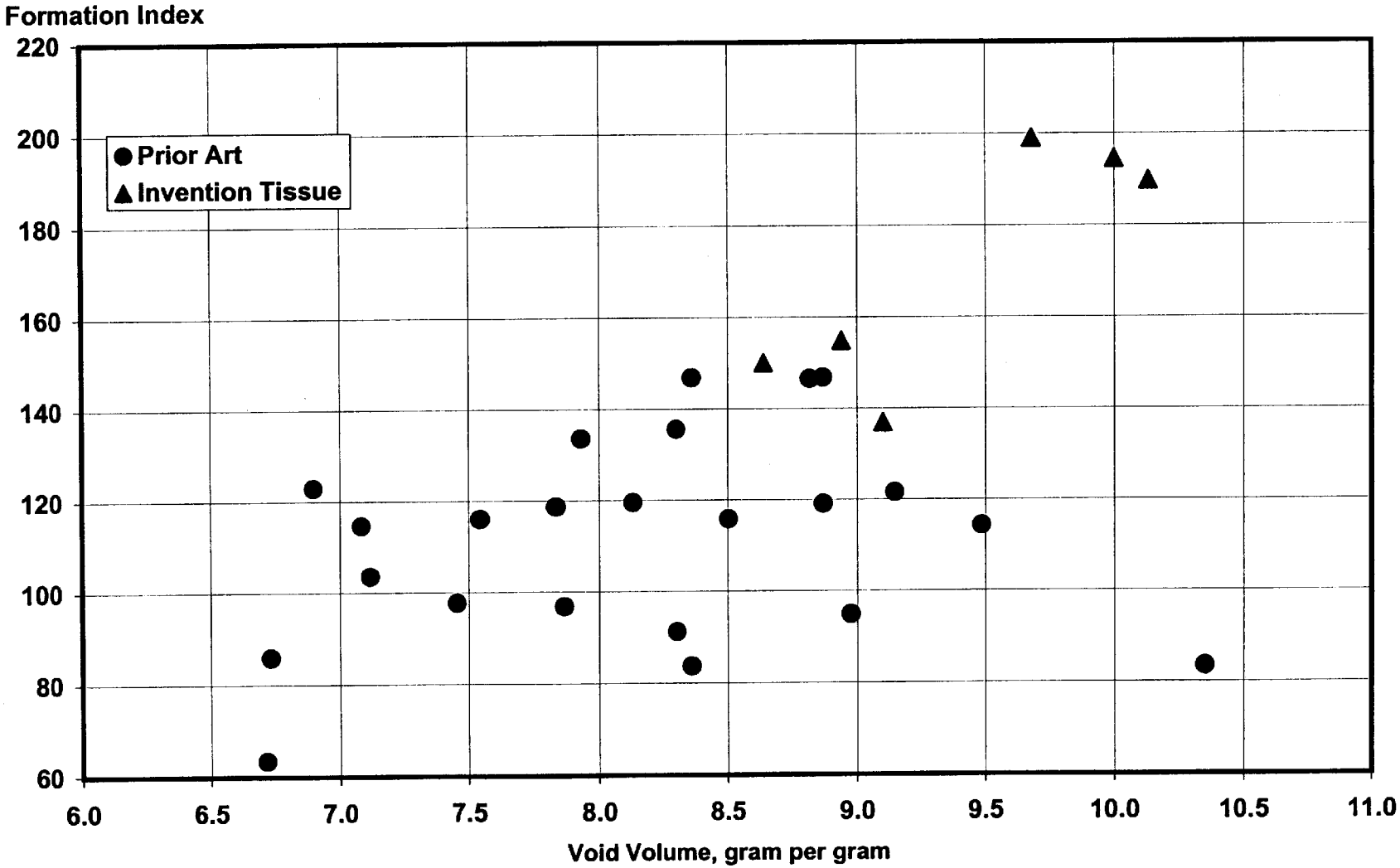
FIG. 2 is a plot of the Formation Index versus Void Volume for a number of prior art tissues and for several tissues of this invention.
Figure 3:
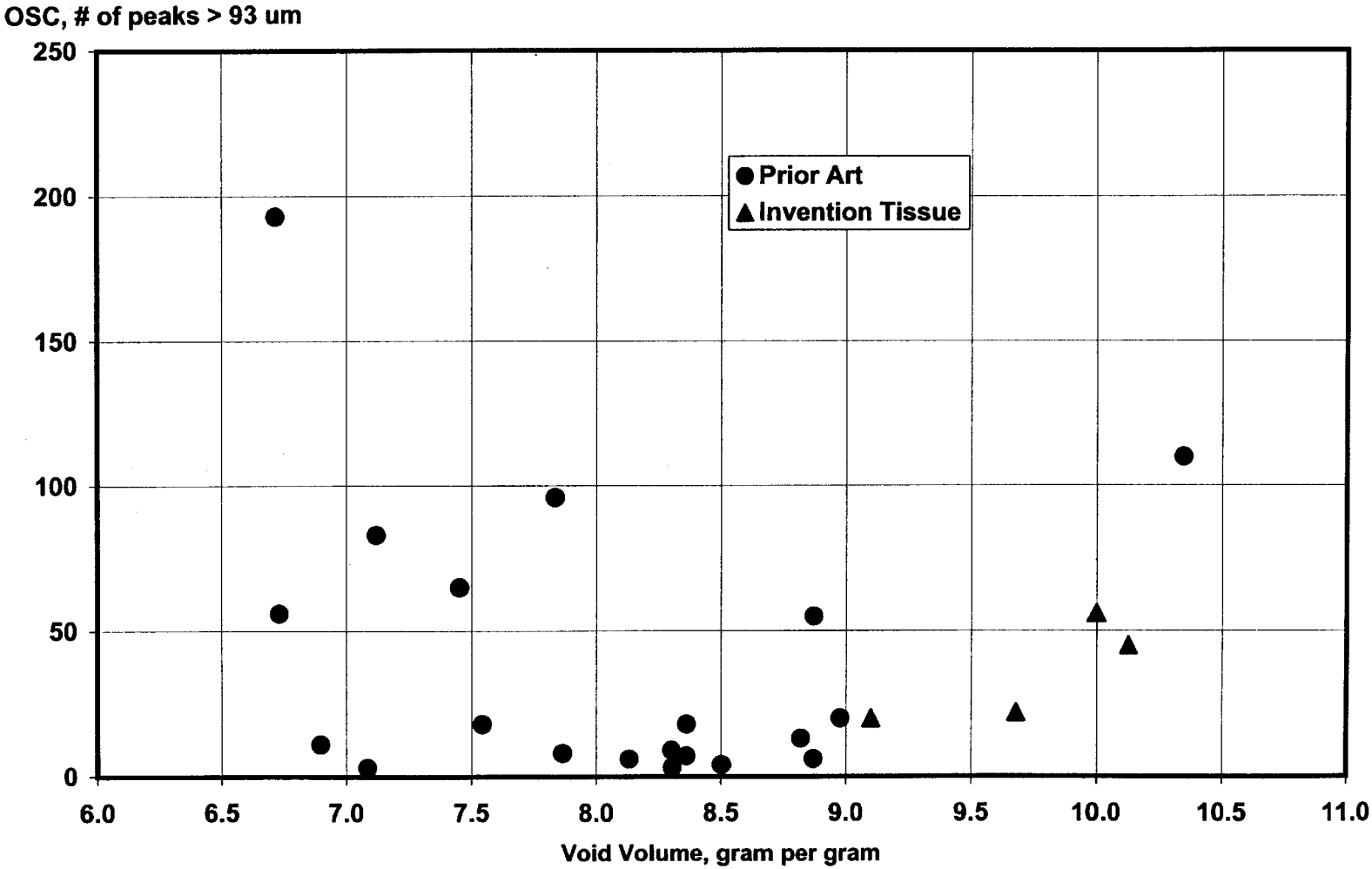
FIG. 3 is a plot of the number of crepe folds having a height of less than 93 microns (Optical Surface Crepe) versus the Void Volume for a number of prior art tissues and for several tissues of this invention.

For purposes of comparison, the Formation Index, the Void Volume and the Optical Surface Crepe properties of examples of this invention are set forth in Table 1 below along with the corresponding properties of a number of commercial prior art tissue products. For ease of comparison, this data is plotted in FIGS. 1, 2 and 3. As shown, none of the prior art products provides the combination of crepe structure, Formation Index, Void Volume of the products of this invention.

TABLE 1

| Code | Void Volume | Formation Index | Optical Surface Crepe (OSC) Peaks > 93 um | Comments |
|---|---|---|---|---|
| KLEENEX ® Facial Tissue 6-99, HTV | 8.4 | 147 | 7 | No Imidazoline |
| KLEENEX ® Facial Tissue 1995, NMC2 | 8.9 | 147 | 6 | No Amidoamine |
| KLEENEX ® Facial Tissue 8-99, FUL2 | 8.5 | 116 | 4 | |
| KLEENEX ® Facial Tissue 1994, NMC | 8.8 | 147 | 13 | No Imidazoline |
| KLEENEX ® Facial Tissue 4 Q 94, BIL1 | 8.1 | 120 | 6 | No Imidazoline |
| KLEENEX ® Facial Tissue 1995, HTV | 8.9 | 119 | 55 | No Imidazoline |
| KLEENEX ® Facial Tissue 1995, FUL | 8.4 | 84 | 18 | No Imidazoline |
| KLEENEX ® Facial Tissue 3 Q 99, NMC2 | 8.3 | 136 | 9 | No Imidazoline |
| KLEENEX ® Facial Tissue 1995, HTV | 9.0 | 95 | 20 | No Imidazoline |
| KLEENEX ® Facial Tissue 1 Q 96, FUL2 | 8.3 | 91 | 3 | No Amidoamine |
| Green Forest Facial Tissue 2-13-97 | 6.7 | 63 | 193 | |
| Kmart American Fare Facial Tissue 1T1547B | 7.9 | 97 | 8 | |
| Whisper Soft Facial Tissue Lot 420137 | 7.5 | 116 | 18 | |
| Scotties 2-ply Facial Tissue E7N10X | 7.8 | 119 | 96 | |
| Scotties 3-ply Facial Tissue 48036RL | 7.1 | 104 | 83 | |
| Chelsea Kirkland Facial Tissue 9-97 | 7.5 | 98 | 65 | |
| Publix Green Facial Tissue 9-97 | 6.7 | 86 | 56 | |
| Puffs Advanced Facial Tissue 8014B12 | 10.3 | 84 | 110 | |
| Chiffon Facial Tissue 024-1-5 | 6.9 | 123 | 11 | |
| Chiffon Facial Tissue 024-2-5 | 7.1 | 115 | 3 | |
| Puffs Facial Tissue 1Q 99 | 9.5 | 114 | | |
| Puffs Facial Tissue 3Q 99 | 9.1 | 122 | | |
| Puffs Facial Tissue 4Q 99 | 7.9 | 134 | | |
| Puffs Facial Tissue 1Q 98 | | | 107 | |
| Puffs Facial Tissue 1-98 Carton 8008B12 | | | 80 | |
| Puffs Facial Tissue 12-97 Carton 7343B12 | | | 63 | |
| Invention Example 1 | 10.1 | 190 | 45 | |
| Invention Example 2 | 9.7 | 199 | 22 | |
| Invention Example 3 | 10.0 | 195 | 56 | |
| Invention Example 4 | 9.1 | 137 | 20 | |
| Invention Tissue | 8.9 | 155 | | |
| Invention Tissue | 8.6 | 150 | | |

It will be appreciated that the foregoing description and example, given for purposes of illustration, are not to be construed as limiting the scope of this invention, which is defined by the following claims and all equivalents thereto.

We claim:

1. A soft tissue comprising from about 0.01 to about 1 dry weight percent of a imidazolinium quaternary compound and from about 0.01 to about 1 dry weight percent of a cationic amidoamine compound, said tissue having a Formation Index of 130 or greater, a Void Volume of 8.5 grams per gram or greater and a crepe structure, as measured by the Optical Surface Crepe method, having 60 or fewer crepe peaks having a peak height of 93 microns or greater.

2. The tissue of claim 1 wherein the Void Volume is 9.0 or greater.

3. The tissue of claim 1 wherein the Void Volume is 9.5 or greater.

4. The tissue of claim 1 wherein the Formation Index is 160 or greater.

5. The tissue of claim 1 wherein the Formation Index is 180 or greater.

6. The tissue of claim 1 wherein the crepe structure, as measured by the Optical Surface Crepe method, has 50 or fewer crepe peaks having a peak height of 93 microns or greater.

7. The tissue of claim 1 wherein the crepe structure, as measured by the Optical Surface Crepe method, has 40 or fewer crepe peaks having a peak height of 93 microns or greater.

8. The tissue of claim 1 wherein the crepe structure, as measured by the Optical Surface Crepe method, has 30 or fewer crepe peaks having a peak height of 93 microns or greater.

9. A soft tissue comprising from about 0.01 to about 1 dry weight percent of a imidazolinium quaternary compound and from about 0.01 to about 1 dry weight percent of a cationic amidoamine compound, said tissue having a Formation Index of 160 or greater, a Void Volume of 9.0 grams per gram or greater and a crepe structure, as measured by the Optical Surface Crepe method, having 50 or fewer crepe peaks having a peak height of 93 microns or greater.

10. A method of making a soft tissue comprising the steps of: (a) adding an imidazolinium quaternary compound to an aqueous suspension of papermaking fibers; (b) depositing the papermaking fibers onto a papermaking fabric to form a wet web; (c) partially dewatering the wet web; (d) pressing the dewatered web against the surface of a Yankee dryer, wherein the surface of the Yankee dryer contains a creping adhesive and a cationic amidoamine compound; and (e) drying the web and creping the dried web from the surface of the Yankee dryer such that the resulting tissue has a Formation Index of 130 or greater, a Void Volume of 8.5 grams per gram or greater and a crepe structure, as measured by the Optical Surface Crepe method, having 60 or fewer crepe peaks having a peak height of 93 microns or greater.

* * * * *